United States Patent [19]

Conroy

[11] 4,195,301

[45] Mar. 25, 1980

[54] DISC ANTENNA FEED FOR PARABOLIC REFLECTOR

[75] Inventor: Peter J. Conroy, Scottsdale, Ariz.

[73] Assignee: Motorola, Inc., Schaumburg, Ill.

[21] Appl. No.: 821,021

[22] Filed: Aug. 1, 1977

[51] Int. Cl.[2] ..... H01Q 19/12

[52] U.S. Cl. ..... 343/700 MS; 343/840

[58] Field of Search ..... 343/700 MS, 840, 846, 343/781 P

[56] References Cited

U.S. PATENT DOCUMENTS

| | | | |
|---|---|---|---|
| 2,702,858 | 2/1955 | Foster | 343/840 |
| 2,846,678 | 8/1958 | Best | 343/840 |
| 3,009,154 | 11/1961 | Weimar | 343/840 |
| 3,478,362 | 11/1969 | Ricardi et al. | 343/769 |
| 3,665,480 | 5/1972 | Fassett | 343/700 MS |
| 3,680,136 | 7/1972 | Collings | 343/700 MS |
| 3,771,161 | 11/1973 | Phillips | 343/770 |
| 4,042,935 | 8/1977 | Ajioka et al. | 343/840 |
| 4,053,895 | 11/1977 | Malacisi | 343/700 MS |
| 4,060,810 | 11/1977 | Kerr et al. | 343/700 MS |

OTHER PUBLICATIONS

Howell, Microstrip Antennas; IEEE Transactions on Antennas & Propagation, Jan. 1975, pp. 90–93.

*Primary Examiner*—Eli Liberman

*Attorney, Agent, or Firm*—Eugene A. Parsons

[57] ABSTRACT

A generally paraboloidal shaped reflector with a coaxial feedline extending outwardly along the axis thereof and a disc antenna feed mounted in spaced relation from the reflector, said feed including a first disc forming a ground plane mounted coaxially on the feedline and a second disc forming a disc radiator mounted coaxially on the feedline. The center conductor of the coaxial feedline extends outwardly through the end thereof and back through an opening in the ground plane disc to a feedpoint on the disc radiator.

9 Claims, 5 Drawing Figures

DISC ANTENNA FEED FOR PARABOLIC REFLECTOR

BACKGROUND OF THE INVENTION

In many different types of antennas, such as microwave communications antennas, CATV, MATV, ETV antennas and the like, a parabolic reflector (paraboloidal shape) is illuminated by some type of feed apparatus to provide the desired radiation pattern. It is desirable to provide a symmetrical reflector illumination in both the E and H planes so that the far field radiation pattern is also symmetrical (i.e. the side lobe levels are equal). In some applications it may be required to have polarization diversity, i.e. the ability to transmit or receive in either vertical, horizontal, or circular polarization. Most prior art antennas have a feed device which does not provide the symmetrical illumination, i.e. dipole-disc feed and the like, or the feed device is extremely complicated and expensive.

SUMMARY OF THE INVENTION

The present invention pertains to an antenna including a paraboloidal shaped reflector with a feedline extending coaxially outwardly therefrom having an outer electrical conductor connected electrically to the reflector and an inner electrical conductor extending through the reflector to serve as an input. The feed is a disc antenna which includes a first disc affixed coaxially to the outer conductor and a second disc affixed coaxially to the outer conductor between the reflector and the first disc and spaced from the first disc to form a disc radiator. The inner conductor extends outwardly from the end of the the feedline and back through an opening in the first disc, which forms a ground plane, to a feedpoint on the disc radiator. The disc antenna feed provides symmetrical E and H plane edge illumination and consequently a symmetrical far field pattern. Further, the disc antenna feed is relatively simple and inexpensive to construct.

It is an object of the present invention to provide a new and improved antenna system.

It is a further object of the present invention to provide a disc antenna feed for a parabolic reflector which is relatively simple and inexpensive to manufacture.

It is a further object of the present invention to provide an improved antenna with a parabolic reflector having an improved feed system which provides symmetrical E and H plane illumination for linear or circular polarization.

These and other objects of this invention will become apparent to those skilled in the art upon consideration of the accompanying specification, claims and drawings.

BRIEF DESCRIPTION OF THE DRAWINGS

Referring to the drawings, wherein like characters indicate like parts throughout the Figures.

DESCRIPTION OF THE PREFERRED EMBODIMENT

Figure 1:
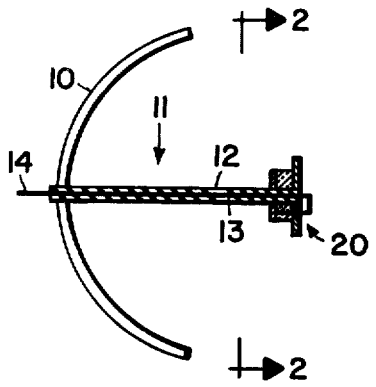
FIG. 1 is a sectional view of an antenna system embodying the present invention.

Referring specifically to FIG. 1, the number 10 indicates a parabolic reflector, which is paraboloidal in shape and has a central opening therethrough coaxial with the axis, or directrix, of the paraboloid. A coaxial feedline, generally designated 11, having a rigid outer conductor 12 and an inner conductor 13, is fixedly mounted in the opening of the reflector 10 so as to extend coaxially outwardly therefrom. The end 14 of the inner conductor which extend through the reflector 10 forms an input terminal for the antenna. A disc antenna feed, generally designated 20, is affixed to the outwardly extended end of the feedline 11.

Figure 2:
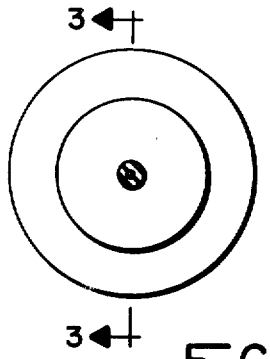
FIG. 2 is an enlarged view as seen from the line 2—2 in FIG. 1.
Figure 3:
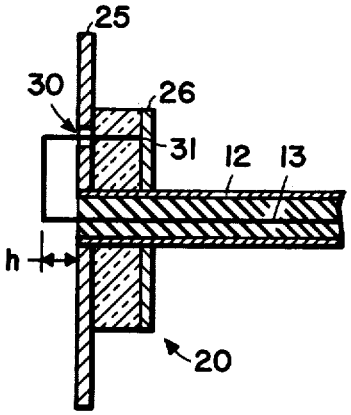
FIG. 3 is a sectional view as seen from the line 3—3 in FIG. 2.

Referring to FIGS. 2 and 3, the disc antenna feed 20 can be seen in more detail. The disc antenna feed 20 includes a first disc 25 affixed coaxially to the outwardly extended end of the rigid outer conductor 12 and a second disc 26 affixed coaxially to the outer conductor 12 between the first disc 25 and the reflector 10. The discs 25 and 26 are formed of electrically conducting material, such as brass or the like, and are mechanically and electrically connected to the outer conductor 12. The center conductor 13 of the coaxial feedline 11 extends outwardly from the outer end of the coaxial line 11 and is bent to extend radially outwardly parallel to the outermost surface of the disc 25. At a predetermined distance from the axis, the center conductor 13 is again bent inwardly to extend through an opening 30 in the disc 25 and is attached to the disc 26 at a feedpoint 31. The radial distance of the feedpoint 31 from the center of the disc 26 determines the impedence of the feedpoint and may, for example, be 50 ohms. Further, the spacing of the center conductor 13 from the surface of disc 25 determines the impedence of that section of the feedline and is determined by the formula $$h=(d/4)\times 10^{Z_o/138}$$

where:

d equals the diameter of the center conductor 13;

$Z_o$ equals the desired impedence of that section of the line (e.g. 50 ohms); and h equals the spacing between the conductor 13 and the surface of the disc 25.

In general, the size of the radiating disc 26 can be determined from the following formula $$D_R=1.841\lambda o/\pi\sqrt{\epsilon_r}$$

where:

$D_R$ is the diameter of the radiating disc 26;

$\lambda o$ is the wavelength of the resonant frequency of the antenna; and $\epsilon_r$ is the dielectric constant of the material separating the discs 25 and 26.

The diameter of the ground plane disc 25 should be greater than 1.3 times the diameter of the radiating disc 26. The diameter of the ground plane disc 25 can be adjusted to give the required edge illumination of the parabolic reflector 10. It is difficult to provide a formula for the calculation of the exact diameter of the ground plane disc 25 since the edge illumination will depend upon the relative size between the disc antenna feed 20 and the parabolic reflector 10 as well as the materials used in the construction of the disc antenna feed. In addition to the above dimensions, the spacing between the discs 25 and 26 should be greater than one one hundredth (0.01) wavelength at the resonant frequency.

Figure 4:
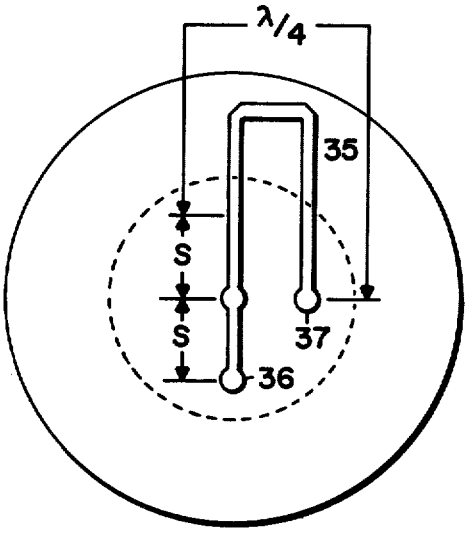
FIG. 4 is a plan view of a circularly polarized disc antenna feed.

With the feedpoint 31 positioned in a vertical radius, as illustrated in FIGS. 2 and 3, the antenna is vertically polarized. If the feedpoint is rotated 90° so that it lies on a horizontal radius the antenna will be horizontally polarized. By providing both feedpoints and connecting the center lead 13 to a microstrip assembly 35 affixed to the rear surface of the disc 25, as illustrated in FIG. 4, both feedpoints, designated 36 and 37, can be fed to produce circular polarization of the antenna. The microstrip assembly 35 introduces a 90° phase shift in the signal applied to the feedpoint 37 to provide the circular polarization.

Figure 5:
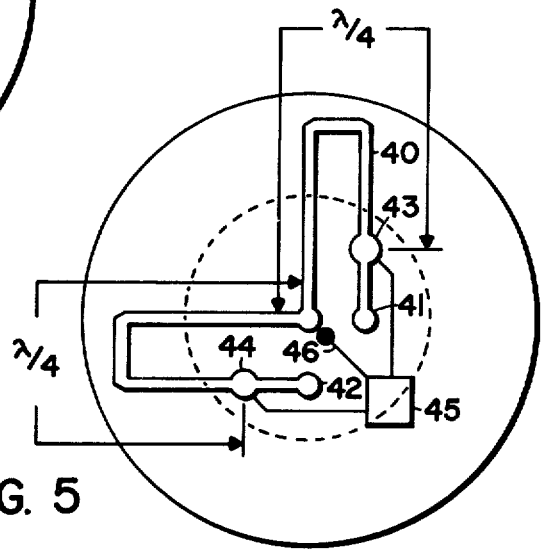
FIG. 5 is a plan view of a disc antenna feed with selectable linear polarization.

In FIG. 5 another embodiment is illustrated in which the antenna can be selectably horizontally or vertically polarized. In this embodiment a microstrip assembly 40 is connected between the center point and two feedpoints 41 and 42. The microstrip assembly 40 includes two switches, which are, for example, pin diodes 43 and 44, located 90° electrically from the center point. The pin diodes are controlled by a switch driver 45, which may be a simple flip-flop, so that one conducts to produce a short in that section of the microstrip assembly when the other is nonconducting. The short is reflected as an open so that only one feedpoint is driven at a time. The number 46 designates a central lead for the switch driver 45, which control lead may, for example, extend along the coaxial feedline 11 to the base.

Thus, an improved antenna is disclosed wherein a parabolic reflector is fed with a disc antenna feed. The disc antenna feed provides symmetrical E and H plane illumination to the parabolic reflector as well as a variety of different polarizations, if desired. In addition, the disc antenna feed is relatively simple to manufacture and extremely inexpensive compared to prior art antennas.

While I have shown and described specific embodiments of this invention further modifications and improvements will occur to those skilled in the art. I desire it to be understood, therefore, that this invention is not limited to the particular form shown and I intend in the appended claims to cover all modifications which do not depart from the spirit and scope of this invention.

What is claimed is:

1. An antenna comprising:

(a) a reflector having a generally paraboloidal shape with an axis through the focus thereof;

(b) a feedline including an outer electrical conductor and an inner electrical conductor, said outer conductor being affixed to said reflector in outwardly extending relationship generally coaxial with the axis of said reflector and said inner conductor extending through an opening in said reflector to form an input for the antenna;

(c) a first disc formed of electrically conducting material and affixed coaxially to the outer conductor in spaced relation to said reflector, said first disc having a first, centrally located opening therethrough and a second opening spaced radially outwardly from the first opening with the inner conductor of said feedline extending outwardly through the first opening and inwardly back through the second opening in spaced relation from said reflector; and (d) a second disc formed of electrically conducting material and affixed coaxially to the outer conductor between said reflector and said first disc and in spaced relation therefrom, the inner conductor of said feedline extending through the second opening of said first disc being electrically connected to said second disc in radially outwardly spaced relation to the center thereof, said first disc forming a ground plane and said second disc forming a disc radiator of a disc antenna feed for said reflector.

2. An antenna as claimed in claim 1 wherein the spacing between the first and second discs is greater than 0.01 wavelength of the resonant frequency of the antenna.

3. An antenna as claimed in claim 1 wherein the diameter of the second disc is approximately equal to $$1.841\lambda o/\pi\sqrt{\epsilon_r}$$

where:

$\lambda o$ = the wavelength of the resonant frequency of the antenna; and $\epsilon_r$ = the dielectric constant of the material between the first and second discs.

4. An antenna as claimed in claim 3 wherein the diameter of the first disc is greater than 1.3 times the diameter of the second disc and is adjusted to provide a predetermined reflector edge illumination.

5. An antenna as claimed in claim 1 wherein the outer conductor is made of rigid material and supports the disc antenna feed in spaced relation from the reflector.

6. An antenna comprising:

(a) a reflector having a generally paraboloidal shape; and (b) a microstrip disc antenna including a disc shaped radiator and a disc shaped ground plane mounted in spaced relation from said reflector for illuminating said reflector upon proper energization of said disc antenna, the diameters of the disc radiator and the ground plane disc being designed to provide substantially constant reflector edge illumination which results in a symmetrical E and H plane far-field radiation pattern, and the diameter of the radiator disc being approximately equal to $$1.841\lambda o/\pi\sqrt{\epsilon_r}$$

where:

$\lambda o$ = the wave length of the resonant frequency of the antenna; and $\epsilon_r$ = the dielectric constant of the material between the first and second discs.

7. An antenna as claimed in claim 6 including in addition a coaxial feedline affixed coaxially to the reflector and the disc antenna for mounting said disc antenna relative to said reflector.

8. An antenna as claimed in claim 6 wherein the disc antenna includes two feedpoints separated by 90° mechanical, and electrical means associated with one of the feedpoints for providing a 90° phase shift to produce circular polarization.

9. An antenna as claimed in claim 8 including in addition switching means for disconnecting one of the feedpoints to provide a desired one of vertical and horizontal polarization.

* * * * *